US008007415B1

(12) United States Patent
Lundquist

(10) Patent No.: US 8,007,415 B1
(45) Date of Patent: Aug. 30, 2011

(54) ADJUSTABLE DUMBBELL AND SYSTEM

(75) Inventor: Randal L. Lundquist, Mansfield, OH (US)

(73) Assignee: Recreation Supply, Inc., Sunbury, OH (US)

( * ) Notice: Subject to any disclaimer, the term of this patent is extended or adjusted under 35 U.S.C. 154(b) by 0 days.

(21) Appl. No.: 12/471,156

(22) Filed: May 22, 2009

(51) Int. Cl.
*A63B 21/072* (2006.01)
*A63B 21/075* (2006.01)

(52) U.S. Cl. ..... 482/107; 482/108

(58) Field of Classification Search ..... 482/93, 482/97, 98, 106–109; D21/680–682
See application file for complete search history.

(56) References Cited

U.S. PATENT DOCUMENTS 5,637,064 A 6/1997 Olson et al.
5,769,762 A 6/1998 Towley, III et al.
6,033,350 A 3/2000 Krull
6,039,678 A 3/2000 Dawson
6,186,928 B1 2/2001 Chen
6,228,003 B1 * 5/2001 Hald et al. ..... 482/107
6,656,093 B2 * 12/2003 Chen ..... 482/108
7,077,791 B2 7/2006 Krull
7,121,988 B2 * 10/2006 Walkerdine ..... 482/106
7,137,931 B2 * 11/2006 Liu ..... 482/107
7,137,932 B2 * 11/2006 Doudiet ..... 482/107
7,261,678 B2 * 8/2007 Crawford et al. ..... 482/107
7,452,312 B2 * 11/2008 Liu ..... 482/108
7,485,077 B2 * 2/2009 Chen ..... 482/108
2004/0005969 A1 * 1/2004 Chen ..... 482/107
2007/0161474 A1 * 7/2007 Lippitt ..... 482/106
2007/0184945 A1 * 8/2007 Lin ..... 482/107
2008/0188362 A1 * 8/2008 Chen ..... 482/107

* cited by examiner

*Primary Examiner* — Allana Lewin
(74) *Attorney, Agent, or Firm* — Standley Law Group LLP

(57) ABSTRACT

An adjustable weightlifting device having selectable weights. The adjustable weightlifting device allows users to select a desired number of weight plates, and then couples the selected weight plates to retention members disposed in the handle of the device.

19 Claims, 10 Drawing Sheets

ADJUSTABLE DUMBBELL AND SYSTEM

BACKGROUND OF THE INVENTIVE FIELD

The present invention is directed to a weightlifting device. More particularly, exemplary embodiments of the present invention are directed to an adjustable weight dumbbell device and system having an internal plate retention mechanism.

Many weightlifters perform a variety of exercises to build and develop muscle. These exercises can be performed through the use of free weights or the use of weightlifting machines. While both free weights and weightlifting machines provide a means to develop and build muscle, many weightlifters prefer the natural motion afforded by the use of free weights, such as dumbbells and barbells. The ability to move naturally allows the weightlifter a greater degree of variety in their exercise routine and the ability to isolate specific muscles.

Although conventional dumbbells provide the freedom desired by weightlifters, conventional dumbbells have several drawbacks. Many conventional dumbbells are made of a cast metal and therefore provide the user with a fixed weight. The fixed weight dumbbells prevent a user from adjusting the amount of weight used, thus decreasing the amount of exercise options available to the user. Other conventional dumbbells are provided with removable weight plates allowing the user to adjust the weight to be lifted. These types of dumbbells may require the clamps, brackets, screws to secure the weight plates to the dumbbell. Although allowing the weight to be adjusted, the attachment devices may be cumbersome and subject to failure potentially injuring the user or others.

Advanced versions of dumbbells and barbells are devices that have attachable weights mounted on a weight lifting bar. In these embodiments, the weights may be prevented from falling from the bar through the use of screws or clamps disposed outside the weights on the bar. These devices are often inconvenient to mount onto the bar and remove from the bar. Each of these mechanisms must be placed separately on the bar. Another drawback of this type of weight lifting system is the expense of purchasing separate pieces of equipment for each different weight desired to be used by the weightlifter.

Even more advanced versions of dumbbells and barbells are devices that allow the user to select a desired amount of weight to be lifted from a stack of weights. However, many of these devices interfere with the natural movement of the user during the lifting motion. These devices force the user to insert a hand into a cage to lift the weight, severely limiting the movement of the user's wrist. These devices may also be cumbersome to use. Although the devices allow a user to select a desired amount of weight, the width of the dumbbell and barbell may be static making the device unstable during use. In addition, these devices offer little in the way of safety.

SUMMARY OF THE GENERAL INVENTIVE CONCEPT

A weight lifting device of the present invention takes the form of a handle that includes off-set passages inside the handle and locking mechanisms attached to each end of the handle. A stack of individual weight plates arranged adjacent to the locking mechanisms. The weight plates are supported by a base, the base is adapted to prevent the bottoms of the weight plates from contacting the base.

A retention member is placed within each passage in the handle. The retention member includes a rod having a series of holes running down a portion of the rod and a retention bar. The retention bar extends perpendicularly from an end of the rod. The rod is adapted to slide and rotate within the handle. In other exemplary embodiments the rod is adapted to slide in the handle and prevented from rotating.

The weight plates include a vertical guide, a channel and a retention groove. When the plates are stacked and supported in the base the vertical guides and channels of each plate are aligned allowing the retention member to pass through the plates. The vertical guide is adapted to allow the retention bar to pass through the plate and the channel is adapted to allow the rod to pass through the plate.

To use the weight lifting device to exercise, a user extends the retention member through a desired number of plates on both ends of the device. Next the user rotates the retention bar into the retention groove of the selected weight plate. When the retention bar is placed in the retention groove the holes on the rod are aligned with the locking mechanisms. The useer then engages the pin inside the locking mechanism with the aligned hole. This prevents the rod from rotating and moving longitudinally. The weight plate is prevented from slipping off the end of the rod by the retention bar nested in the retention groove.

In other exemplary embodiments, the retention member includes a rod, an attachment member and a retention pin. In this embodiment, the rod is shaped in a manner such that it is prevented from rotating relative to the handle and weight plates. The attachment member is adapted to attach the retention pin to the rod. The retention pin in this embodiment is a spring loaded pull pin. The weight plates are adapted to receive the retention member of this embodiment. The vertical guide in the weight plate is adapted to slidably receive the retention pin, and a retention tab is located in the vertical guide. The retention tab and retention plate are each adapted to retain the selected weight plates to the rod.

In other exemplary embodiments, the weight lifting device may have support adapted to cradle the locking mechanisms providing automatic locking and unlocking of the locking mechanism. In this embodiment, the locking mechanism includes a pin extending through the body of the locking mechanism. The locking mechanism is positioned transverse to the rod running through the locking mechanism.

When the locking mechanism is removed from the support, a channel disposed in the support forces the pin to engage the rod inside the locking mechanism preventing movement of the rod. As the weight lifting device is lowered onto the base, and the locking mechanisms enter the support, another channel disposed in the support forces the pin to disengage from the rod allowing the rod to freely slide allowing a different number of weight plates to be selected.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
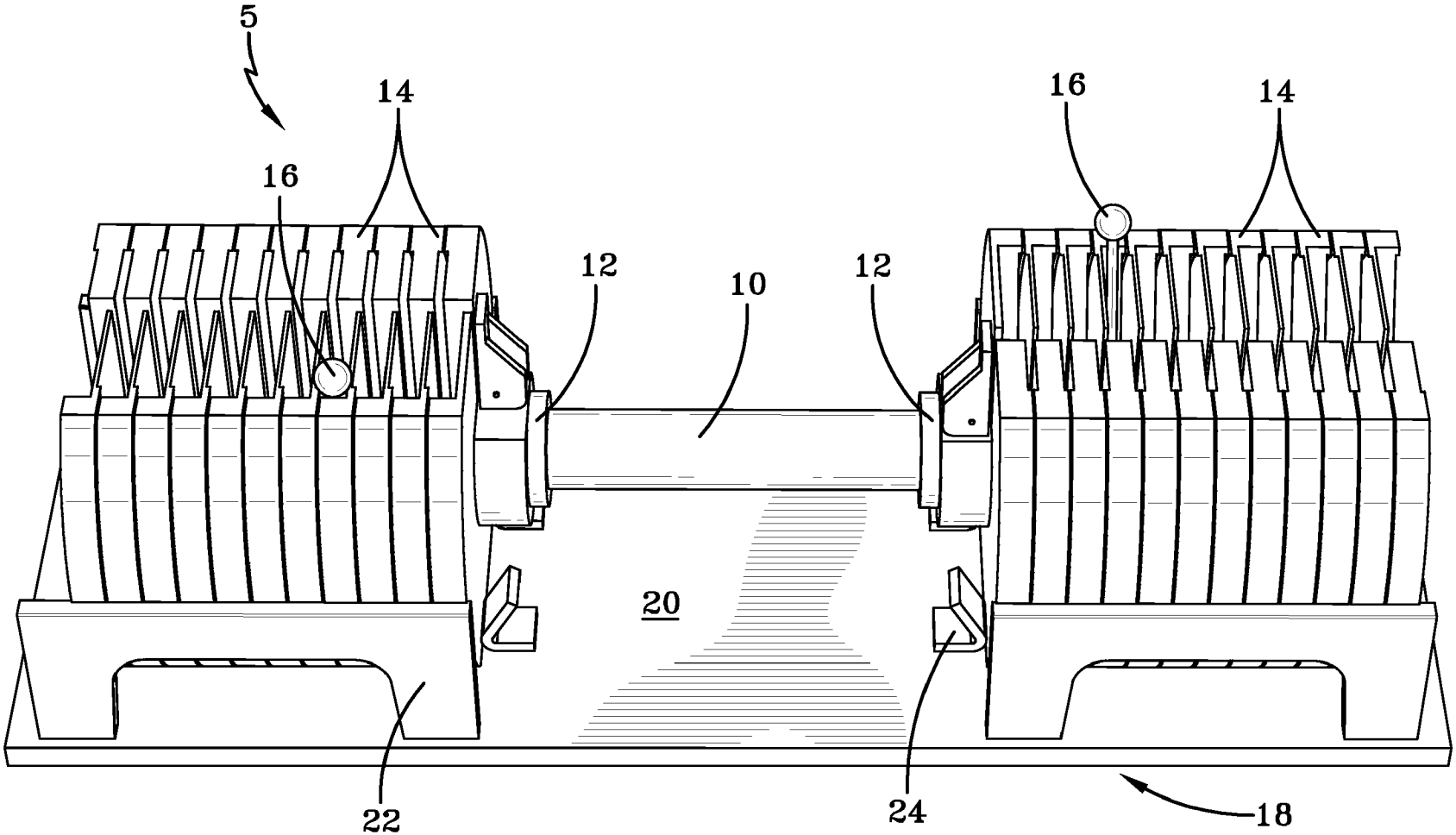
FIG. 1 is a perspective view of one exemplary embodiment of an adjustable dumbbell of the present invention.
Figure 2:
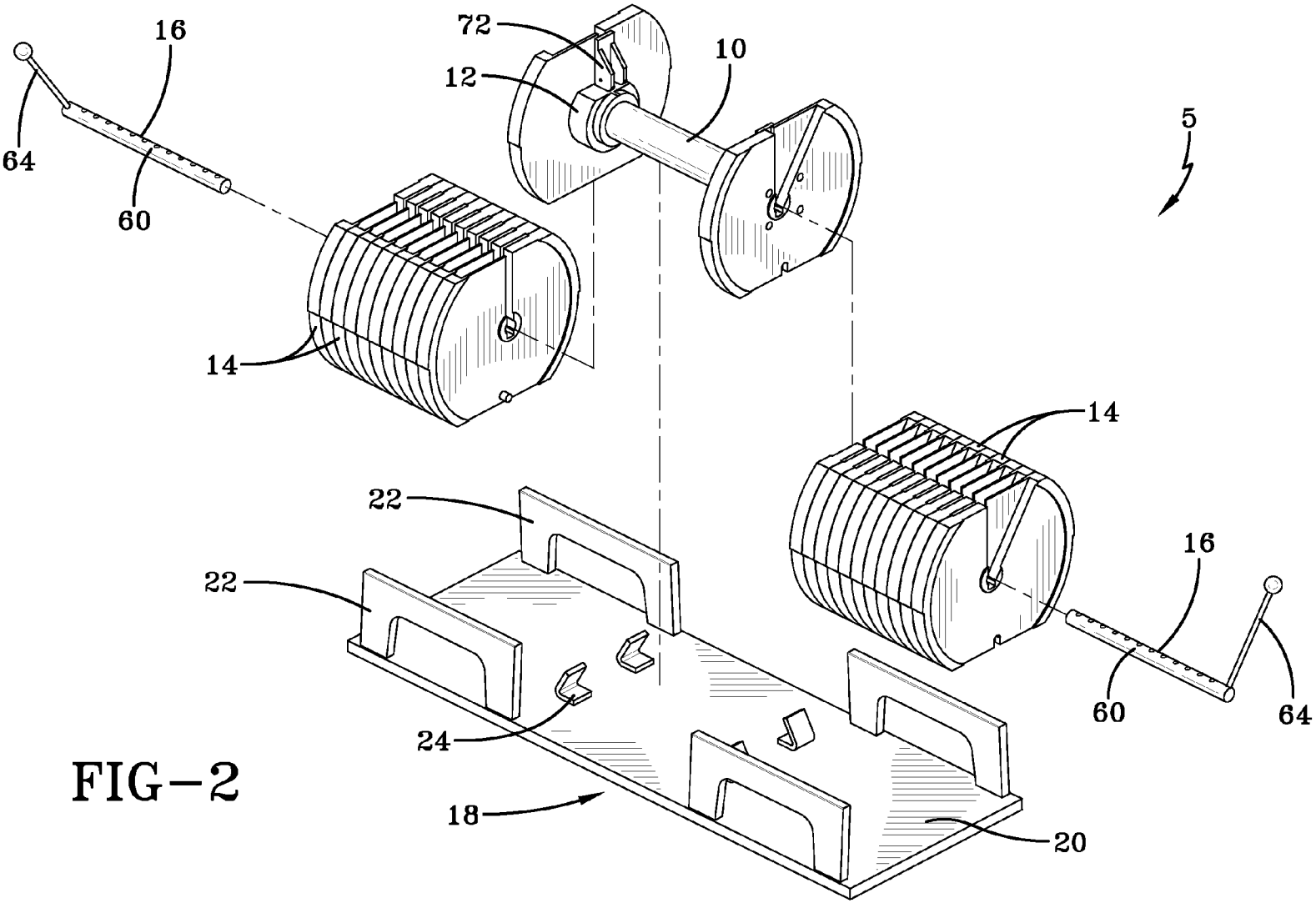
FIG. 2 is an exploded view of one exemplary embodiment of an adjustable dumbbell of the present invention.

One exemplary embodiment of an adjustable dumbbell device 5 (adjustable dumbbell) of the present invention is illustrated in FIG. 1, and is depicted in more detail in the exploded view of FIG. 2 and in the component drawings of FIGS. 3-7. As shown, the adjustable dumbbell 5 includes a handle 10 having opposing locking mechanisms 12 attached to the end portions thereof. A plurality of selectable weight plates 14 positioned adjacent to the locking mechanisms 12. A retention member 16 is disposed within each end of the handle 10 and extends from the handle 10 through the weight plates 14, the purpose of which is described in more detail below. A base 18 is also provided and includes a base plate 20, and plate rests 22 and plate guides 24 extending upwardly from the top surface of the base plate 20.

As shown in FIG. 2, the plate rests 22 are affixed to the top surface of the base plate 20 and extend upwardly therefrom. The plate rests 22 are adapted to contact and support the weight plates 14. As shown in FIG. 2, the plate rests 22 may be arranged in sets of two wherein the plate rests 22 of each set are parallel to one another. The plate guides 24 affixed to the top surface of the base plate 20 may extend upwardly at an angle therefrom. The angled configuration, as seen in FIG. 2, forces the weight plates 14 onto the plate rests 22 and into the proper stacked configuration so as to be arranged vertically side-by-side. In other exemplary embodiments, plate guides 24 may extend from the base plate 20 on either end of the stacked weight plates 14. In still other exemplary embodiments, plate guides 24 may extend from the base plate 20 from at both ends of the stacked weight plates 14.

Figure 3:
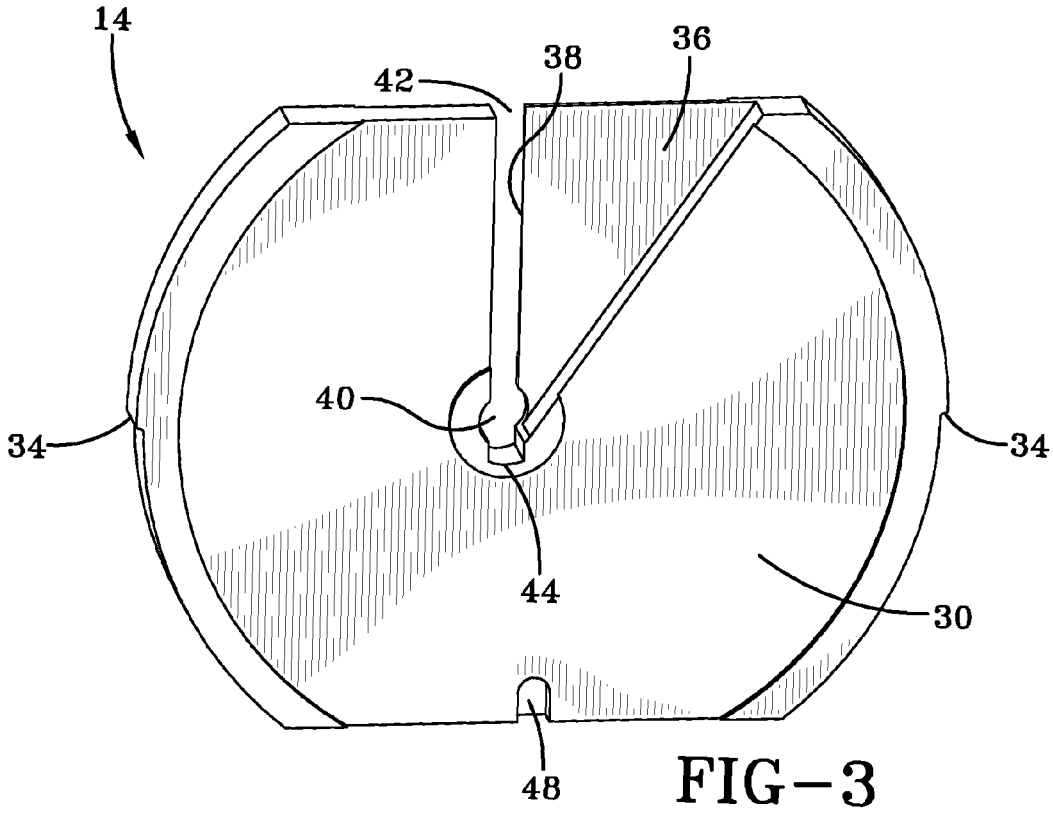
FIG. 3 is a side view of an exemplary weight plate of the adjustable dumbbell of FIG. 1.
Figure 4:
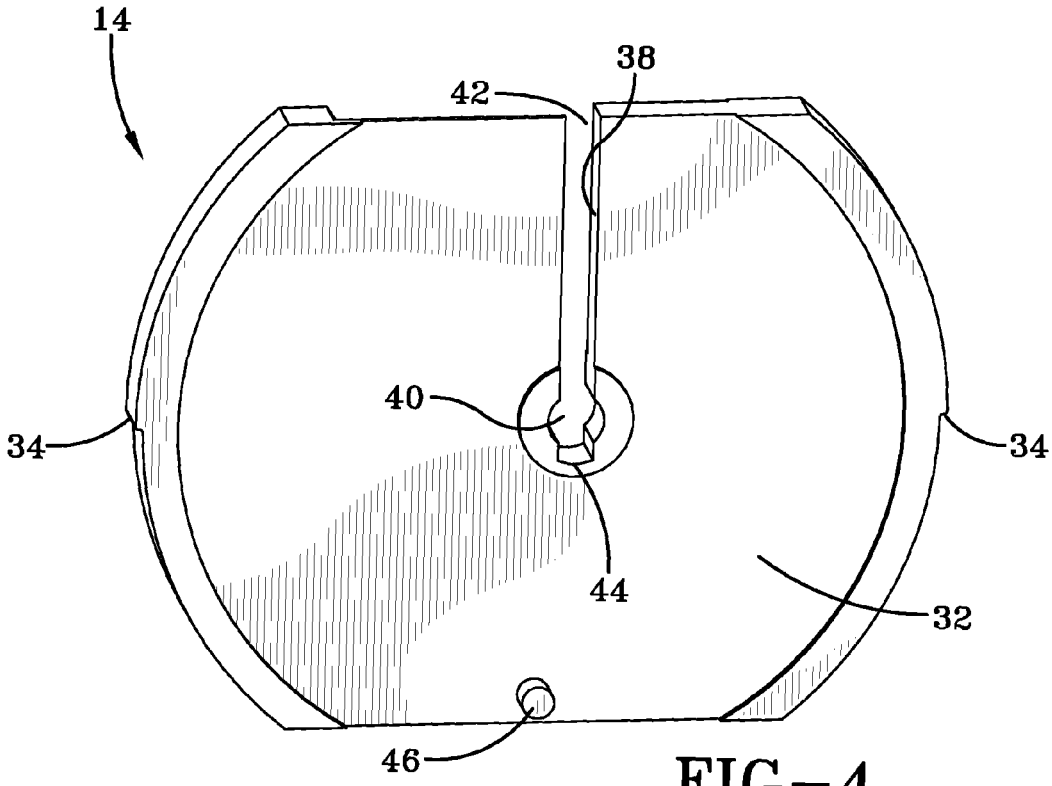
FIG. 4 is a side view of an exemplary weight plate of the adjustable dumbbell of FIG. 1.

A weight plate of the exemplary adjustable dumbbell 5 is depicted in FIGS. 3-4. The weight plate includes a first side 30 and a second side 32. The weight plates 14 are stacked so that the first side 30 faces away from the handle 10 and the second side 32 faces the handle 10. A number of notches 34 are disposed in the weight plate 14. The notches 34 are positioned on opposing sides of the weight plate 14 and are adapted so that the weight plate 14 may rest erectly on the plate rests 22. The notches 34 and plate rests 22 may be adapted to prevent the lower portion of the weight plate 14 from contacting base plate 20. This prevents the stack of weight plates 14 from binding when removed from and placed into the base 18. In other exemplary embodiments, the notches 34 and plate rests 22 may be adapted to allow the lower portion of the weight plate 14 to contact the base plate 20. In still other exemplary embodiments, the weight plates 14 may be adapted to rest directly on any surface without the need for a base 18.

Figure 9:
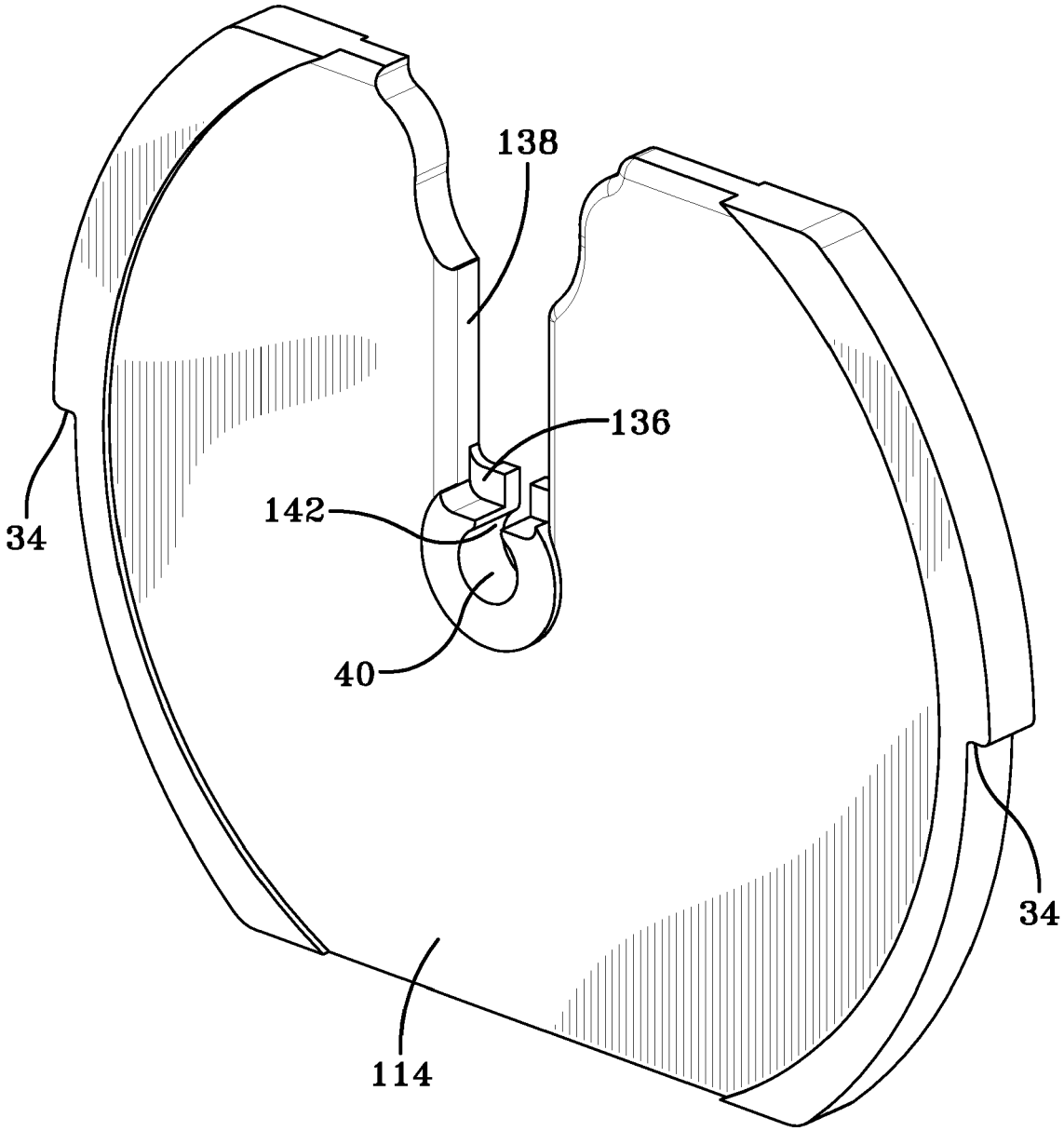
FIG. 9 is a top perspective view of an exemplary weight plate of the adjustable dumbbell of FIG. 8.
Figure 12:
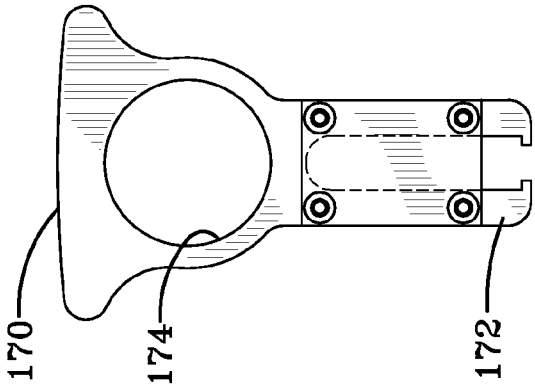
FIG. 12 is a front view of an exemplary retention pin of the adjustable dumbbell of FIG. 8.
Figure 10:
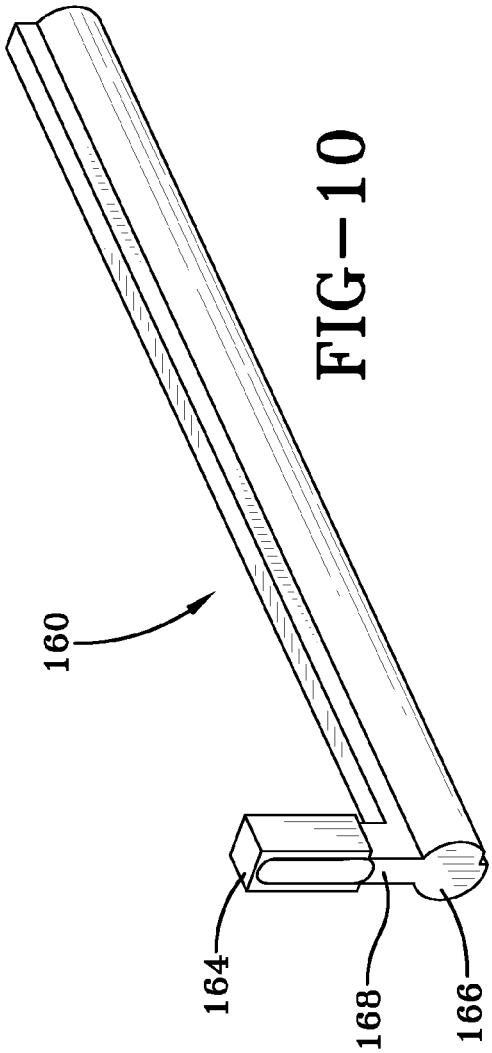
FIG. 10 is a perspective view of an exemplary retention member of the adjustable dumbbell of FIG. 8.
Figure 11:
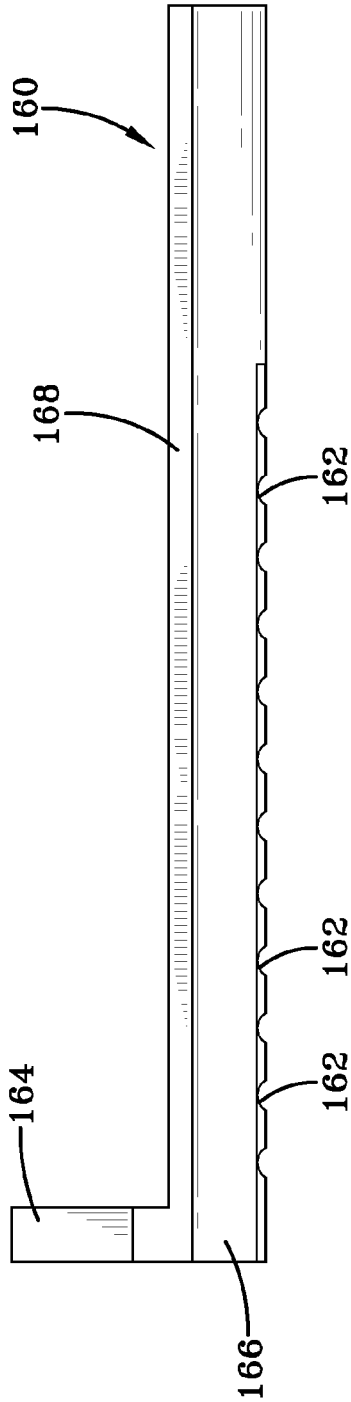
FIG. 11 is a side view of an exemplary retention member of the adjustable dumbbell of FIG. 8.

Weight plates 14 of the exemplary adjustable dumbbell 5 also includes a vertical guide 38 vertically aligned in the weight plate 14 intersecting with a lateral channel 40 located in the weight plate 14. The vertical guide 38 includes an open end 42 and a terminal end 44. In some exemplary embodiments, the vertical guide 38 may terminate in the lateral channel 40 (as shown in FIG. 9). As shown in FIGS. 3-4, the lateral channel 40 has a circular configuration and has an interior diameter greater than the width of the intersecting vertical guide 38. The lateral channel 40 is also adapted to slidably receive the retention member 16 (shown in FIG. 6), as described in more detail below. In some exemplary embodiments, the lateral channel 40 is adapted to rotatably and slidably receive a portion of the retention member 16. Although the lateral channel 40 is shown in a circular configuration, it should be understood by those skilled in the art that substantially any shape may be used, including, but not limited to, rectangular and triangular shapes.

The weight plate 14 may also include a stacking pin 46 extending from a lower portion of the second side 32 thereof. A corresponding pin groove 48 may be disposed in the lower portion of the first side 30 of the weight plate 14. The pin groove 48 is adapted to receive the stacking pin 46 of adjacent weight plates 14 when in a stacked configuration. The interlocking of the stacking pin 46 and the pin groove 48 prevents the weight plates 14 from rotating relative to one another. This interlocking provides a more stable exercise motion without the need for cumbersome stabilizing features and aids in alignment of the lateral channels 40 of each stacked weight plate 14. Although a pin groove 48 and a corresponding stacking pin 46 are contemplated, it should be understood by those skilled in the art that that a variety of concave/convex complimentary features may be used to interlock the weight plates 14 and prevent the weight plates 14 from rotating relative to one another.

A retention groove 36 is also disposed within the first side 30 of the weight plate 14. The retention groove 36 is adapted to receive the retention bar 64 (shown in FIG. 6) portion of the retention member 16, described in greater detail below. As shown in FIG. 3, the retention groove 36 may extend from the lateral channel 40 to an outer edge of the weight plate 14.

Figure 5:
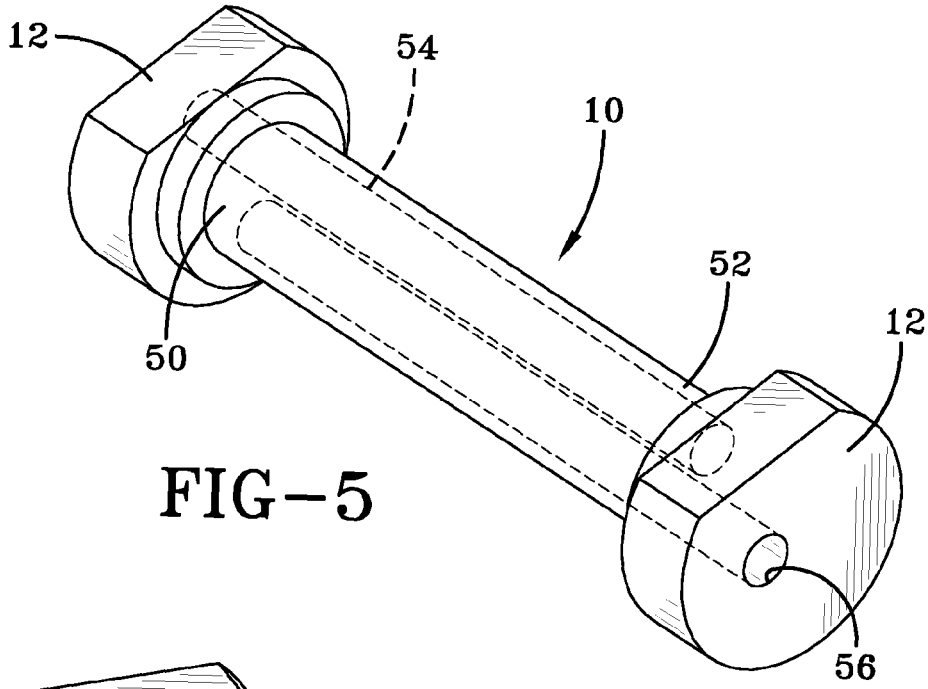
FIG. 5 is a perspective view of an exemplary handle of the adjustable dumbbell of FIG. 1.

The handle 10 of the exemplary adjustable dumbbell 5 is depicted in FIG. 5. The handle 10 includes a first end 50 and a second end 52, each end having a locking mechanism 12 affixed thereto and extending radially and outwardly therefrom. The handle 10 has a first passage 54 and a second passage 56 disposed therein. The first passage 54 extends laterally into the handle 10 from the first end 50 and the second passage 56 extends laterally into the handle 10 from the second end 52. The first passage 50 and the second passage 54 are offset so as to not intersect with one another inside the handle 10. The first and second passages 54 and 56 are adapted to slidably receive the rod 60 (shown in FIG. 6) portion of the retention member 16, as described in more detail below. In other exemplary embodiments, the first and second passages 54 and 56 are adapted to slidably and rotatably receive the rod 60 portion of the retention member 16.

Figure 6:
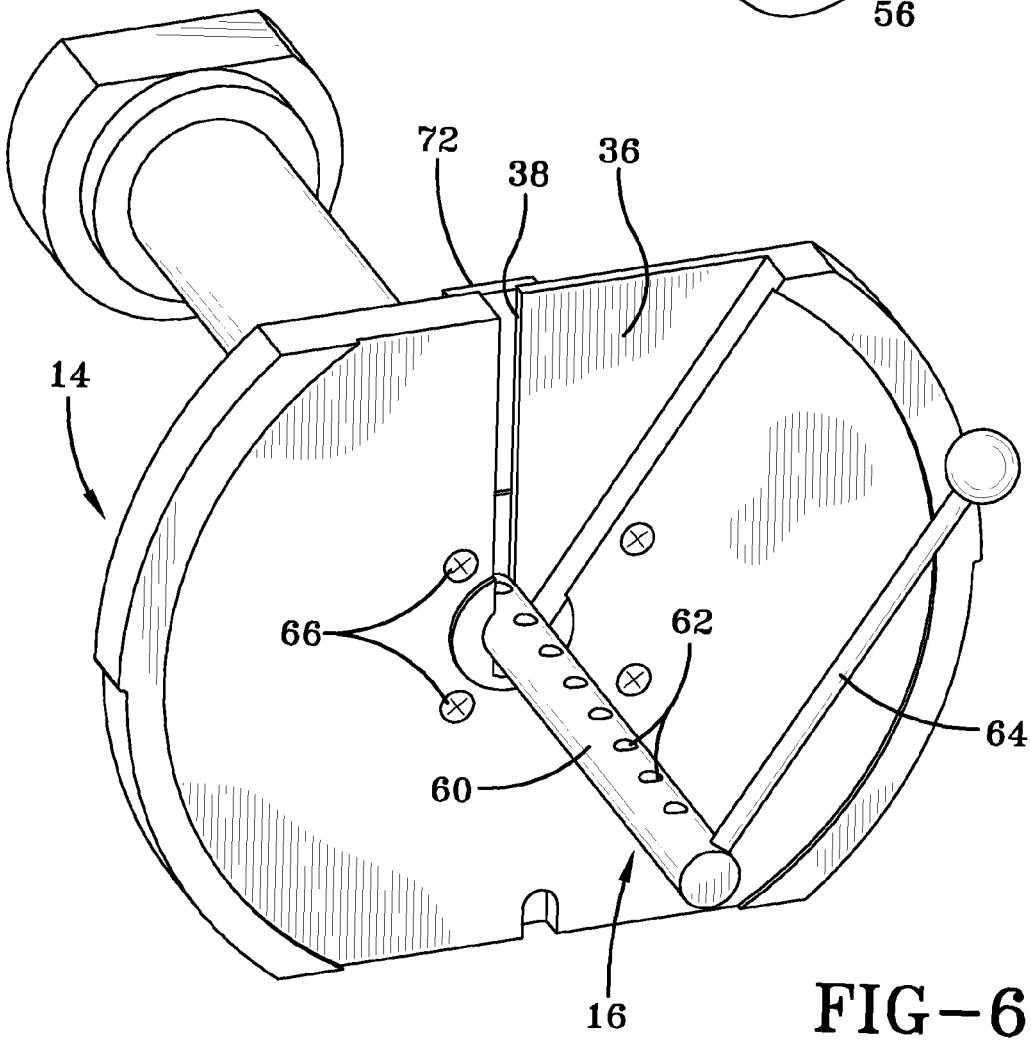
FIG. 6 is a perspective view of an exemplary retention member of the adjustable dumbbell of FIG. 1.

The retention member 16 of the exemplary adjustable dumbbell 5 is depicted in FIG. 6. The retention member 16 includes a rod 60 having a series of holes 62 and a retention bar 64. The rod 60 has a longitudinal axis and is adapted to be received by the lateral channels 40 in the weight plates 14 and adapted to be slidably received by the passages 54, 56 in the handle 10. The retention bar 64 extends substantially perpendicular from the longitudinal axis of the rod 60. The distal end of the retention bar 64 may be adapted to allow a user to easily manipulate the retention bar 64 and rod 60. The retention bar 64 may be further adapted to facilitate passage through the vertical guide 38 in the weight plates 14.

The series of holes 62 may be arranged in a straight line running along the exterior of the rod 60. The holes 62 may traverse the entire rod 60 or only a portion of the rod 60. The spacing between the holes 62 corresponds to the distance between the retention grooves 36 in the weight plates 14, when the weight plates 14 are in a stacked configuration. The holes 62 are located so that when the retention member 16 is rotated, engaging the retention bar 64 with the retention groove 36 in a weight plate 14, the holes 62 align with the pin 70 (shown in FIG. 7) in the locking mechanism 12.

FIG. 6 also illustrates an exemplary embodiment where at least one weight plate 14 may be attached to each locking mechanisms 12. Although the use of mechanical fasteners 66 are contemplated it should be understood by those skilled in the art that other forms of attachment may be suitable, such as welds, adhesives, etc. Attachment of a weight plate 14 to the locking mechanism 12 helps to align the handle 10 with the stacked weight plates 14 in the plate rests 22. In this embodiment, the vertical guide 38 may be adapted to receive a portion of the pin lever 72 (shown in FIG. 7) and allow a user easy access to manipulate the pin lever 72.

Figure 7:
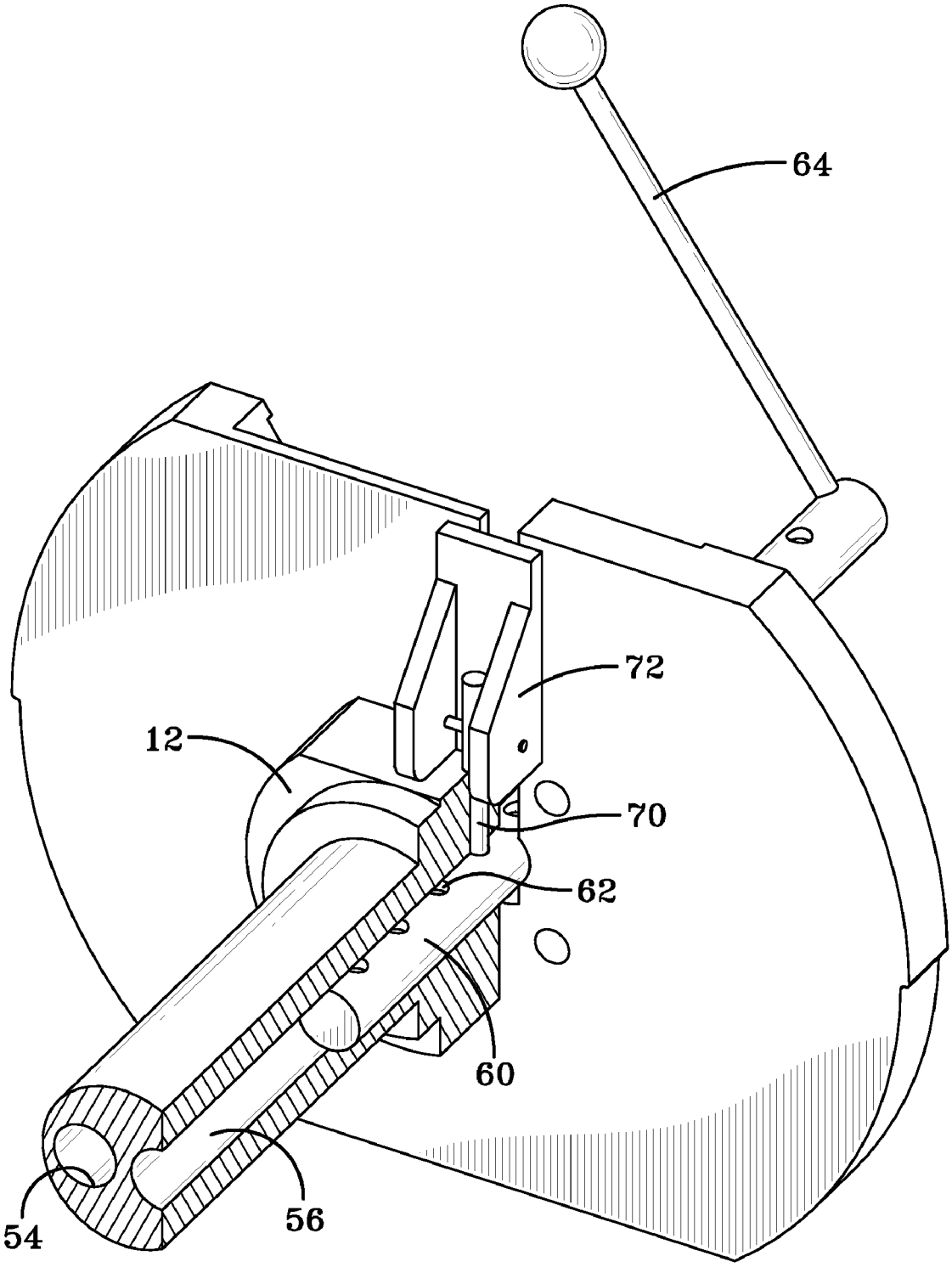
FIG. 7 is a perspective view of an exemplary locking mechanism of the adjustable dumbbell of FIG. 1.

A locking mechanism 12 of the exemplary adjustable dumbbell is depicted in FIG. 7. Locking mechanisms 12 may be attached to the handle 10 at the first and second ends 50 and 52, and are adapted to slidably receive the rod 60 when the locking mechanism 12 is in an unlocked position. A rod 60 may pass through each locking mechanism 12 and be inserted into each passage 54,56 within the handle 10. When in a locked position, the locking mechanisms 12 eliminate the rotational motion and longitudinal displacement of the rod 60 disposed therein. To lock the rods 60 into place, the locking mechanisms 12 may employ a pin 70 in communication with a pin lever 72. The pin 70 may pass through the locking mechanism 12 and be inserted into a hole 62 on the rod 60 to prevent rod 60 movement (locked position). It should be understood by those skilled in the art that while the use of a pin 70 is contemplated other devices may be used. The pin lever 72 may be manipulated by a user to engage the pin 70 with a desired hole 62 (locked position) and again to disengage the pin 70 from a hole 62 to allow the rod 60 to move. The arrangement of the retention bar 64 and holes 62 are such that when the retention bar 64 is placed in a retention groove 36, at least one hole 62 is aligned with the pin 70.

An additional safety feature may be provided by elongating the pin lever 72 so that when the pin lever 72 is in the unlocked position, the pin lever 72 interferes with the user's ability to grip the handle 10. This interference prevents the user from lifting the adjustable dumbbell 100 when the retention member 16 is not locked, and thus preventing the weight plates 14 from falling off the adjustable dumbbell and injuring the user.

An exemplary embodiment of an adjustable dumbbell 5 of the present invention is basically constructed as described above. Operation of the adjustable dumbbell is described below.

To select a desired amount of weight plates 14 for an exercise, a user extends the rod 60 from the handle 10 through the later channels 40 of the stacked weight plates 14 supported by the plate rests 22 by manipulating the retention bar 64. Once rod 60 has been extended to the desired weight plate 14, the user rotates the rod 60 by placing the retention bar 64 into the retention groove 36. The rotation of the rod 60 aligns the holes 62 with the pin 70 within the locking mechanism 12. The engagement between the retention bar 64 and the retention groove 36 prevents the selected weight plates 14 from sliding off the rod 60. A user may then manipulate the pin lever 72 to engage the pin 70 with a hole 62 in the rod 60, preventing longitudinal and rotational movement of the rod 60 (locked position). This process is repeated for both sides of the adjustable dumbbell 5. In this manner, the adjustable dumbbell 5 allows the user to select the amount of weight on each side independently. In addition, weight plates 14 may be added and removed from the rod 60 without removing the rod 60 from the handle 10. The user may then lift the handle 10 and attached weight plates 14, while the unselected weight plates 14 remain in the base 18.

Figure 8:
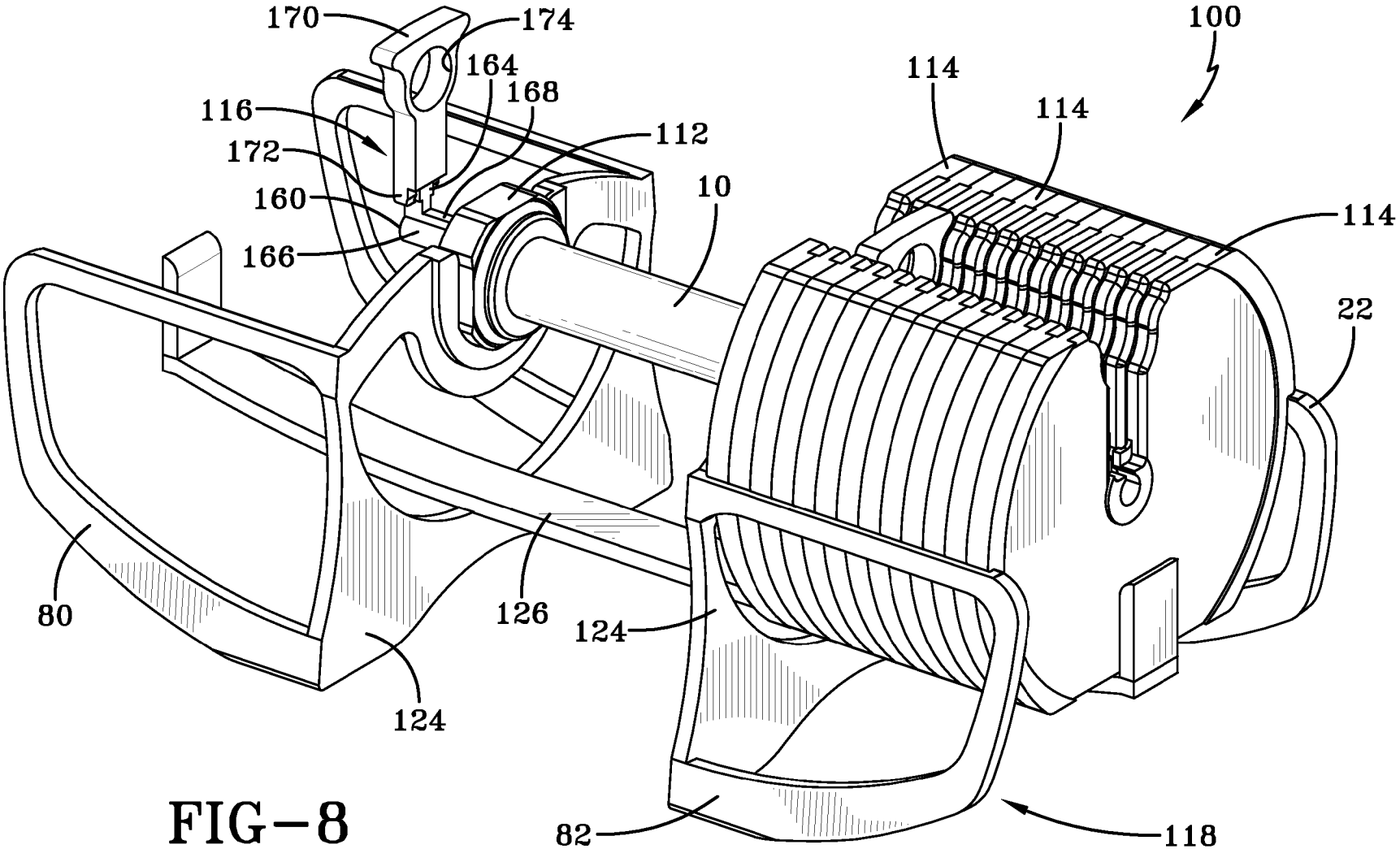
FIG. 8 is a top perspective view of a second exemplary embodiment of an adjustable dumbbell of the present invention.

Another exemplary embodiment of an adjustable dumbbell device 100 (adjustable dumbbell) of the present invention is illustrated in FIG. 8 and in the component drawings of FIGS. 9-14. As shown, the exemplary embodiment of the adjustable dumbbell 100 includes a handle 10 having opposing locking mechanisms 112 attached to the end portions thereof. A plurality of selectable weight plates 114 positioned adjacent to the locking mechanisms 112. A retention member 116 is disposed within each end of the handle 10 and extends from the handle 10 through the weight plates 14. A base 118 is provided and includes plate rests 22 arranged in a first set 80 and a second set 82. The base further includes supports 124 attached to the first and second sets 80, 82 of plate rests 122 and a weight guide 126 affixed to the supports 124.

As shown in FIG. 8, the plate rests 22 extend downward and are adapted to interface with a support surface, such as a floor, shelf or rack. In this manner a base plate 20 as described above is unnecessary; however, it should be understood to one skilled in the art that base plate 20 may still be employed. The plate rests 22 are further adapted to support the weight plates 114. The plate rests 22 are arranged to form a first set 80 and a second set 82. A support 124 is attached to each set 80, 82 of plate rests 22. The supports 124 are adapted to cradle the locking mechanisms 112 and facilitate locking and unlocking of the locking mechanism 112, as will be described in detail below. A weight guide 126 may be affixed to and run between the supports 124. The distal ends of the weight guide 126 may be turned up and adapted to guide the weight plates 114 into the stacked configuration.

A weight plate 114 of an exemplary embodiment of the adjustable dumbbell 100 is depicted in FIG. 9. The weight plate 114 includes a number of notches 34. The notches 34 are positioned on opposing sides of the weight plate 14 and are adapted to engage the plate rests 22. As described above, the notches 34 and plate rests 22 are adapted to prevent the lower portions of the weight plates 114 from contacting any surface, such as a support surface or base plate 20. In other embodiments, the notches 34 and plate rests 22 may be adapted to allow the lower portions of the weight plates 114 to rest against a surface for further support.

Weight plates 114 of the exemplary adjustable dumbbell 100 also includes a vertical guide 138 intersecting with a lateral channel 40 located in the weight plate 114. The vertical guide 138 extends from the outer portion of the weight plate 114 and terminates in the lateral channel 40. As shown in FIG. 9, the lateral channel 40 has a circular configuration and includes an opening 142. The lateral channel 40 is adapted to slidably receive the rod 160 of the retention member 116. The lateral channel 40 has an interior width greater then the width of the opening 142, thus keeping the rod 160 disposed within the lateral channel 40. Although the lateral channel 40 is shown in a circular configuration, it should be understood by those skilled in the art that substantially any shape may be used, including, but not limited to, rectangular and triangular shapes.

Retention tabs 136 are disposed in the lower portion of the vertical guide 138, near the intersection of the vertical guide 138 and the lateral channel 40. The retention tabs 136 are adapted to complimentary engage the lower portion 172 of the retention pin 170 of the retention member 116, to prevent the selected weight plates 114 from sliding off the rod 160. In other exemplary embodiments, the retention tabs 136 may be positioned at any location within the vertical guide 138. In still other exemplary embodiments, multiple retention tabs 136 may be placed at various locations within the vertical guide 138

The handle 10 is described above in FIG. 5 and includes offset first and second passages 54, 56 disposed therein. The first and second passages 54, 56 are adapted to slidably receive the rod 160.

As shown in FIG. 8, the adjustable dumbbell 100 includes a retention member 116. The retention members 116 are slidably disposed within each of the handle's 10 passages 54, 56. The retention member 116 is adapted to affix a selected number of weight plates 114 to the handle 10 so that a user may adjust the weight of the adjustable dumbbell 100. The retention member 116 is comprised of several components depicted in more detail in FIGS. 10-12. The retention member 116 includes a rod 160; an attachment member 164, and a retention pin 170. The rod 160 is adapted to be slidably disposed within the passages 54, 56 of the handle 10 and includes a series of depressions 162. The rod 160 is also adapted to pass through the locking mechanisms 112 and be inserted into the first and second passages 54, 56 within the handle 10. As the passages 54, 56 are adapted to slidably receive the rod 160, the passages 54, 56 may be contoured to the shape of the rod 160, preventing rotation of the rod 160 within the handle 10.

In this embodiment, the rod 160 includes a lower portion 166 and an upper portion 168. The lower portion 166 is adapted to be slidably received by the lateral channel 40 in the weight plates 114. The upper portion 168 of the rod 160 extends into the vertical guide 138 through the opening 142; preventing rotation of the weight plate 114 about the longitudinal axis of the rod 160. This feature eliminates the need for the pin 46 and pin groove 48 to prevent weight plate 114 rotation about the longitudinal axis of the rod 160, as described in other exemplary embodiments shown in FIGS. 2-4. Although some embodiments may include both anti-rotation features; it should be understood by those skilled in the art that the rod 160 may take any shape preventing weight plate 114 rotation about the longitudinal axis of the rod 160.

The attachment member 164 extends from the rod 160 and is adapted to secure the retention pin 170 to the rod 160. In some exemplary embodiments, the attachment member 164 extends substantially perpendicular from the longitudinal axis of the rod 160. Although depicted in FIG. 10 as extending from the distal end of the rod 160, the attachment member 164 may extend from any point along the longitude of the rod 160. An exemplary embodiment of a retention pin 170 used in the retention member 116 is depicted to FIG. 12. The retention pin 170 includes a lower portion 172, this lower portion 172 is adapted to receive the attachment member 164 and surround the upper portion 168 of the rod 160. A spring or other resilient member (not shown in the Figures) may be interposed between the attachment member 164 and the retention pin 170, thereby spring loading the retention pin 170 and applying a downward force to the retention pin 170. The retention pin 170 also includes an aperture 174 or other similar component providing easy manipulation by a user.

The retention pin 170 is adapted to nest in the vertical guide 138. When the retention pin 170 is nested in the vertical guide 138 the lower portion 172 of the retention pin 170 is in complimentary engagement with the retention tabs 136. This engagement prevents the selected weight plates 114 from sliding off the end of the rod 160. In other exemplary embodiments additional retention tabs 136 may be added to the vertical guide 138.

The depressions 162 are arranged in a straight line running the along the exterior of the rod 160 for engagement with the spring load pin 190 (shown in FIG. 13) of the locking mechanism 112. The depressions 162 may run the entire length of the rod 160 or only a portion of the rod 160. The spacing between the depressions 162 corresponds to the distance between the retention tabs 136 in the weight plate 114, when the weight plates 114 are in a stacked configuration.

Figure 13:
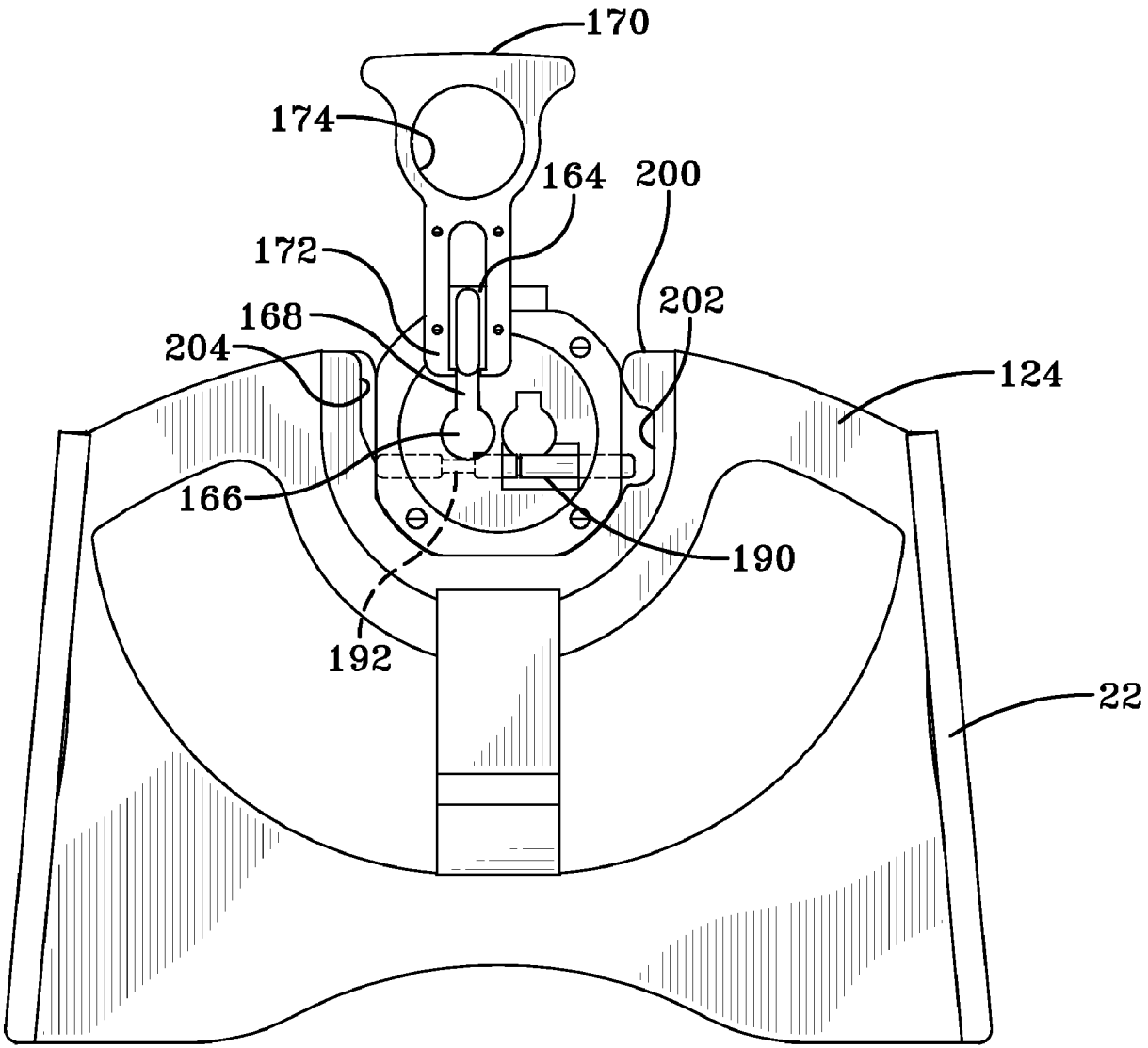
FIG. 13 is a front view of an exemplary locking mechanism in the unlocked position of the adjustable dumbbell of FIG. 8.
Figure 14:
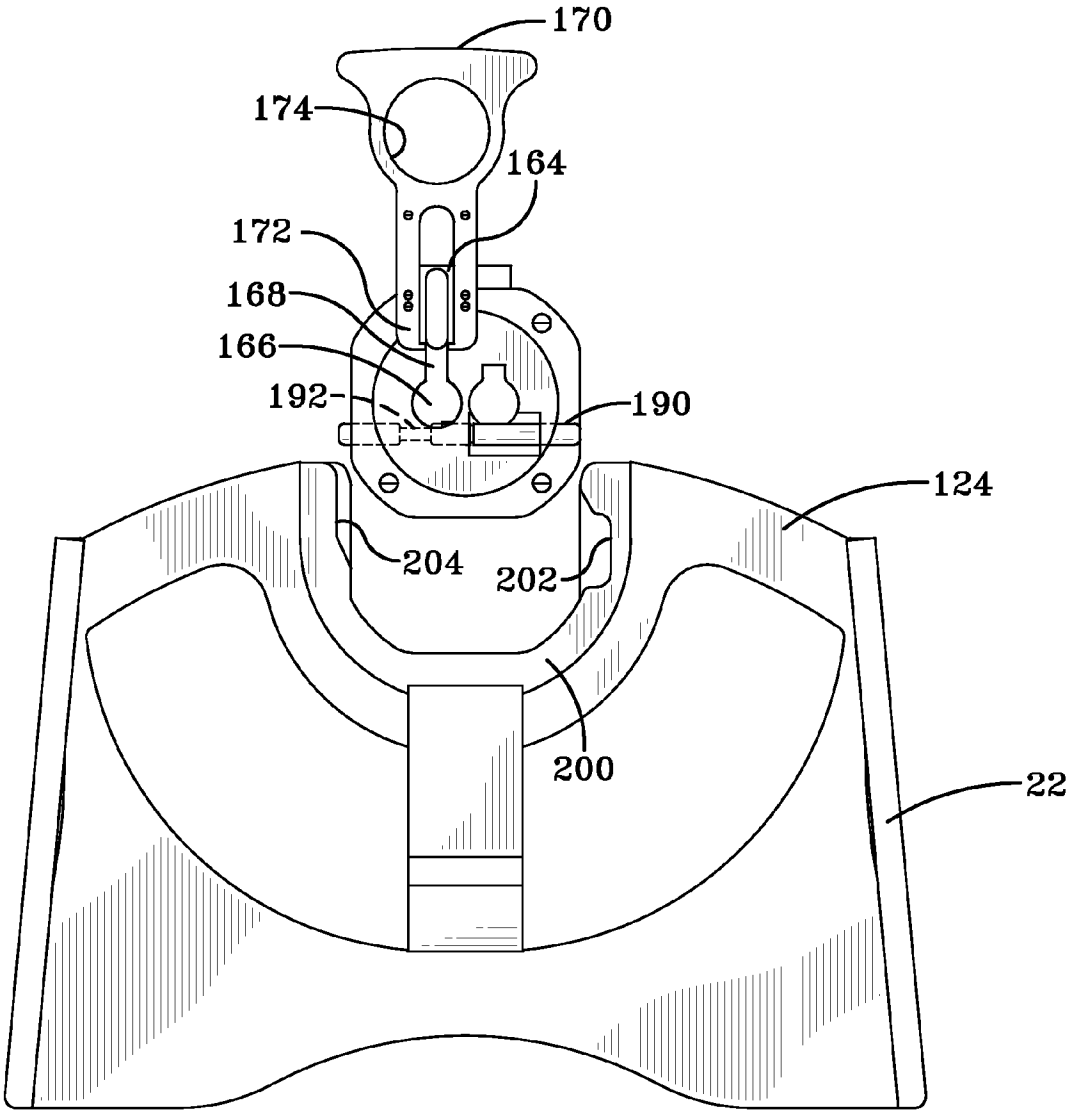
FIG. 14 is a front view of an exemplary locking mechanism in the locked position of the adjustable dumbbell of FIG. 8.

A locking mechanism 112 and support 124 of the exemplary adjustable dumbbell is depicted in FIGS. 13-14. The locking mechanism 112 depicted in FIG. 13 is in the unlocked position allowing the rod 160 to be moved longitudinally. The locking mechanism 112 depicted in FIG. 14 is in the locked position preventing longitudinal movement of the rod 160. As described above, a locking mechanism 112 may be attached to each end of the handle 10, and adapted to slidably receive the rod 160 when in an unlocked position. In this embodiment the locking mechanism includes a pin 190 extending transverse to the rod 160. The pin 190 traverses the locking mechanism 112 and is disposed horizontally therein so as to engage a depression 162 on the rod 160 when in a locked position. The pin 190 includes a complimentary portion 192 allowing longitudinal movement of the rod 160 when in an unlocked position. As shown in FIGS. 13 and 14 the complimentary portion 192 of the rod 160 is an area of decreased diameter as compared to the remainder of the rod 160. In some exemplary embodiments, the pin 190 may be spring loaded forcing the pin into the locked position. The pin 190 has a length such that an end portion may extend beyond the body of the locking mechanism 112 when in both the locked and unlocked position.

The aforementioned support 124 includes a receptacle 200 disposed therein and adapted to receive and support the locking mechanism 112. The support 124 further includes a locking channel 202 and an unlocking channel 204 disposed in the sides of the receptacle 200. The locking channel 202 is adapted to force the pin 190 into a locked position as the locking mechanism 112 is removed from the receptacle 200. The unlocking channel 204 is adapted to force the pin 190 into an unlocked position when the locking mechanism 112 is placed in the receptacle 200. To ensure correct movement of the pin 190 into the locked position as the locking mechanisms 112 are removed from the receptacles 200, the locking mechanisms 112 may have substantially square cross-section having rounded corners. This shape prevents rotation of the locking mechanism 112 within the receptacles 200. By eliminating rotation of the locking mechanism 112 relative to the receptacle 200, it ensures engagement of the pin 190 with the locking channel 202 moving the pin 190 into the locked position. It should be understood by those skilled in the art that although a locking mechanism 112 with a substantially square cross-section is contemplated, the locking mechanism 112 have any shape preventing rotation of the locking mechanism 112 within the receptacle while allowing easy ingress and egress.

The locking mechanism 112, receptacle 200, and retention member 116 also provide an important safety feature to the adjustable dumbbell 100. If a user fails to properly nest the retention pin 170 within the vertical guide 138 so as to contact the lower portion 172 of the retention pin 170 with the retention tab 136, the pin 190 located within the locking mechanism 112 will not align properly with the series of depressions 162 in the rod 160. When the pin 190 is not aligned with the depressions 162 the pin 190 is prevented from moving into the locked position. When a user attempts to remove the locking mechanism 112 from the receptacle 200 when the pin 190 is prevented from moving into the locked position, the locking channel 202 prevents the locking mechanism from exiting the receptacle 200. In this manner, the adjustable dumbbell 100 prevents usage when the retention member 116 is not properly placed and locked to eliminate the possibility of the weight plate 114 falling from the retention member 116 potentially injuring the user.

An exemplary embodiment of an adjustable dumbbell 100 of the present invention is basically constructed as described above. Operation of the adjustable dumbbell is described below.

To select a desirable amount of weight plates 114 for an exercise, a user extends the rod 160 from the handle 10 through the lateral channels 40 of the weight plates 114 by manipulating the retention pin 170. To extend the rod 160, the pin 170 is lifted so as the clear the retention tabs 136. Once the desired number of weight plates 114 has been selected the retention pin 170 is lowered into the vertical guide 138 of the desired weight plate 114. The lower portion 172 of the retention pin 170 engages the retention tab 136 preventing the selected weight plates 114 from falling off the rod 160. Once the desired number of weight plates 114 has been selected on both sides of the adjustable dumbbell 100, the user may lift the handle 10 and attached weight plates 114 from the base 118. As the locking mechanisms 112 are removed from the support 124, the pin 190 engages a depression 162 in rod 160 preventing longitudinal motion of the rod 160. After completion of the exercise, the adjustable dumbbell 100 is lowered into the base 118 aligning the locking mechanisms 112 with the supports 124. As the locking mechanisms 112 enter the support 124 the pin 190 is forced into the unlocked position by the unlocking channel 204 allowing the rod 160 to move longitudinally.

While certain embodiments of the present invention are described in detail above, the scope of the invention is not to be considered limited by such disclosure, and modifications are possible without departing from the spirit of the invention as evidenced by the following claims:

What is claimed is:

1. A weight lifting apparatus, comprising:

a handle having a first end portion and an opposing end portion;

a locking mechanism disposed on at least one said end portion of said handle, said locking mechanism comprising a pin therein;

a retention member slidably disposed within said locking mechanism and said handle, said retention member comprising a rod, an attachment member, and a retention pin, said rod adapted to be slidably disposed within said locking mechanism and said handle, said rod further including a series of depressions on the exterior of said rod, said depressions adapted to receive said pin of the locking mechanism when in a locked position;

a plurality of weights adjacent said end portions of said handle bearing said locking mechanism, each said weight having a channel, a vertical guide, and at least one retention tab disposed within said vertical guide, said vertical guide and said channel are aligned with said retention member so as to slidably receive said retention member, said at least one retention tab adapted to engage said retention pin to temporarily secure a selected number of weights to said handle; and a base, said base comprising plate rests and supports, said supports having a receptacle for receiving said locking mechanism, said receptacle having an unlocking and locking channel disposed therein.

2. The weight lifting apparatus of claim 1, wherein said locking channel is adapted to force said pin of the locking mechanism into a locked position when said locking mechanism is removed from said receptacle, thereby preventing longitudinal movement of said retention member.

3. The weight lifting apparatus of claim 1, wherein said unlocking channel is adapted to force said pin into an unlocked position when said locking mechanism is placed in said receptacle, thereby allowing longitudinal movement of the retention member.

4. The weight lifting apparatus of claim 1, further comprising a resilient member interposed between said attachment member and said retention pin, so as to force said retention pin into complimentary engagement with said retention tab.

5. The weight lifting apparatus of claim 1, wherein each said weight includes a protrusion on a first side thereof and a groove on a second side thereof, said groove adapted to receive said protrusion from an adjacent weight when in a stacked configuration.

6. A weight lifting device, comprising:

a handle having end portions;

at least one retention member slidably disposed within said handle, said retention member longitudinally movable relative to said handle;

a locking mechanism disposed on at least one said end portion of said handle, said locking mechanism having a movable pin horizontally disposed therein, said movable pin engaged with said retention member preventing longitudinal movement when in a locked position; and a plurality of weights removably attached to said retention member.

7. The weight lifting device of claim 6, wherein each said weight includes a protrusion on a first side thereof and a groove on a second side thereof, said groove adapted to receive said protrusion from an adjacent weight when in a stacked position.

8. The weight lifting device of claim 6, wherein said retention member comprises a rod, an attachment member, and a retention pin, said rod including a series of depressions on its exterior for engaging said movable pin.

9. The weight lifting device of claim 6, wherein each said weight includes a channel, a vertical guide, and at least one retention tab disposed within said vertical guide.

10. The weight lifting device of claim 6, further comprising a support having at least one receptacle for receiving said locking mechanism disposed therein, said receptacle having a locking and unlocking channel.

11. The weight lifting device of claim 10, wherein said locking channel forces said movable pin into a locked position when said locking mechanism is removed from said receptacle.

12. The weight lifting device of claim 10, wherein said unlocking channel forces said movable pin into an unlocked position when said locking mechanism is placed in said receptacle, so as to allow longitudinal movement of said retention member.

13. A weight lifting device, comprising:

a handle having end portions;

at least one retention member slidably disposed within said handle, said retention member longitudinally movable relative to said handle and non-rotatable relative to said handle;

a locking mechanism disposed on at least one of said end portions of said handle, said locking mechanism having a movable pin disposed therein, said movable pin engaged with said retention member preventing longitudinal movement of said retention member when in a locked position;

a plurality of weights removably attached to said retention member; and a support having at least one receptacle for receiving said locking mechanism disposed therein, said receptacle having a locking and an unlocking channel.

14. The weight lifting device of claim 13, wherein each said weights includes a protrusion on a first side thereof and groove on a second side thereof, said groove adapted to receive said protrusion from an adjacent weight when in a stacked position.

15. The weight lifting device of claim 13, wherein said retention member comprises a rod, an attachment member, and retention pin, said rod preventing rotation of said retention member relative to said handle.

16. The weight lifting device of claim 13, wherein each said weight includes a channel, a vertical guide, and at least one retention tab disposed within said vertical guide.

17. The weight lifting device of claim 13, wherein said locking channel forces said movable pin into a locked position when said locking mechanism is removed from said receptacle.

18. The weight lifting device of claim 13, wherein the movable pin is horizontal and biased toward the locked position.

19. The weight lifting device of claim 13, wherein said unlocking channel forces said movable pin into an unlocked position when said locking mechanism is placed in said receptacle so as to allow longitudinal movement of said retention member.

* * * * *